US009857750B1

(12) United States Patent
Moriya et al.

(10) Patent No.: US 9,857,750 B1
(45) Date of Patent: Jan. 2, 2018

(54) TRANSPORT MONITORING CONTROL DEVICE AND IMAGE FORMING APPARATUS

(71) Applicant: FUJI XEROX CO., LTD., Tokyo (JP)

(72) Inventors: Hideki Moriya, Kanagawa (JP); Hidehiko Yamaguchi, Kanagawa (JP); Kozo Tagawa, Kanagawa (JP); Tsuyoshi Sunohara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/470,370

(22) Filed: Mar. 27, 2017

(30) Foreign Application Priority Data

Aug. 10, 2016 (JP) ..... 2016-157984

(51) Int. Cl.

| | |
|---|---|
| ***G03G 15/00*** | (2006.01) |
| ***B65H 5/06*** | (2006.01) |
| ***B65H 7/08*** | (2006.01) |
| ***B65H 9/00*** | (2006.01) |

(52) U.S. Cl.
CPC ..... *G03G 15/6567* (2013.01); *B65H 5/062* (2013.01); *B65H 7/08* (2013.01); *B65H 9/00* (2013.01); *B65H 2301/331* (2013.01)

(58) Field of Classification Search
None
See application file for complete search history.

(56) References Cited

U.S. PATENT DOCUMENTS

| | | | | |
|---|---|---|---|---|
| 4,608,612 | A * | 8/1986 | Rayfield | G11B 20/20 360/26 |
| 5,278,624 | A * | 1/1994 | Kamprath | B65H 9/002 271/227 |
| 7,717,533 | B2 * | 5/2010 | De Jong | B65H 9/002 271/227 |
| 7,806,404 | B2 * | 10/2010 | deJong | B65H 7/08 271/228 |
| 2006/0056861 | A1 * | 3/2006 | Nojima | G03G 15/6567 399/16 |
| 2007/0253736 | A1 * | 11/2007 | Ehara | G03G 15/0131 399/167 |
| 2013/0056926 | A1 * | 3/2013 | Deno | B65H 7/08 271/228 |
| 2014/0111594 | A1 * | 4/2014 | Schuh | B41J 11/42 347/218 |

FOREIGN PATENT DOCUMENTS

| | | |
|---|---|---|
| JP | 06-278903 A | 10/1994 |
| JP | 2003-267592 A | 9/2003 |

* cited by examiner

*Primary Examiner* — WB Perkey
(74) *Attorney, Agent, or Firm* — Sughrue Mion, PLLC

(57) ABSTRACT

A transport monitoring control device includes a transport unit configured to transport a recording medium while nipping the recording medium, a driving unit configured to drive the transport unit, a detector configured to detect a waveform related to a load of the driving unit when the recording medium enters the transport unit or is discharged from the transport unit, and a determining unit configured to determine whether the recording medium is skewed with respect to the transport unit, based on a waveform width at a height obtained by multiplying a peak value of the waveform by a predetermined coefficient.

11 Claims, 18 Drawing Sheets

NORMAL STATE

SKEW OCCURRENCE STATE (b < c)
(ADJUST BEARING LOAD BALANCE
ACCORDING TO SKEW AMOUNT)

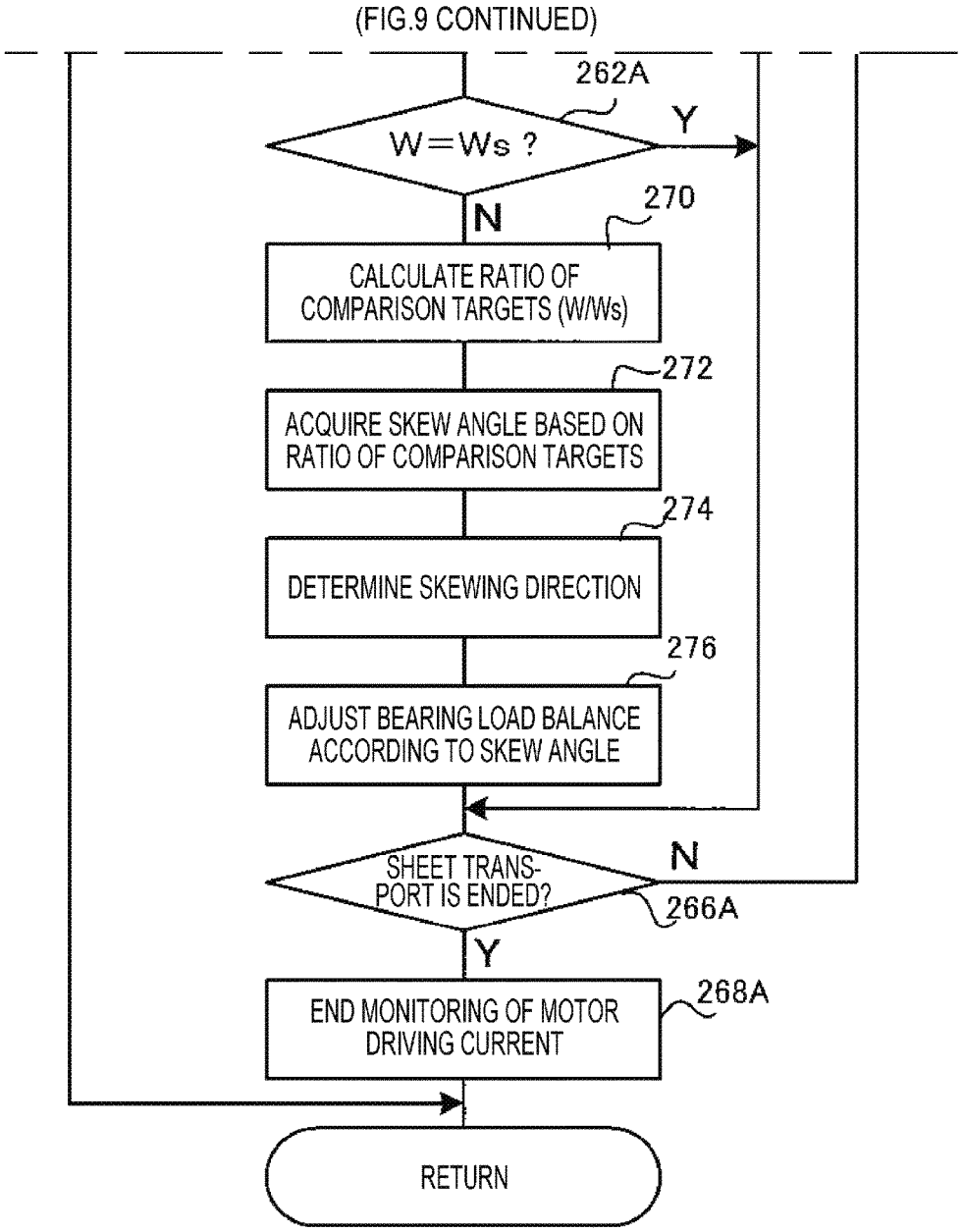
(FIG.9 CONTINUED)
262A
W=Ws ?
Y
N
270
CALCULATE RATIO OF COMPARISON TARGETS (W/Ws)
272
ACQUIRE SKEW ANGLE BASED ON RATIO OF COMPARISON TARGETS
274
DETERMINE SKEWING DIRECTION
276
ADJUST BEARING LOAD BALANCE ACCORDING TO SKEW ANGLE
SHEET TRANS-PORT IS ENDED?
N
266A
Y
END MONITORING OF MOTOR DRIVING CURRENT
268A
RETURN COMPARE COMPARISON VALUE AND SHEET ENTRY CURRENT OR SHEET DISCHARGE CURRENT (SKEW OCCURS AT UPSTREAM SIDE OF PAIR OF ROLLERS)

COMPARE SHEET ENTRY CURRENT AND SHEET DISCHARGE CURRENT (SKEW OCCURS AT PAIR OF ROLLERS)

* THICK SHEET AND THIN SHEET ARE RELATIVELY DIFFERENT IN THICKNESS. (e.g., 2:1)

FIG.11C

| MONITORING ELEMENT \ PAPER TYPE | THICK SHEET | | THIN SHEET | |
|---|---|---|---|---|
| | NON-SKEWED | SKEWED | NON-SKEWED | SKEWED |
| PEAK CURRENT VALUE (H) | 0.16A | 0.08A | 0.08A | 0.04A |
| FEATURE AMOUNT (DIFFERENTIAL) | 4(=0.16A/0.04sec) | 1(=0.08A/0.08sec) | 2(=0.08A/0.04sec) | 0.5(=0.04A/0.08sec) |
| HALF VALUE WIDTH (W) | 0.04sec | 0.08sec | 0.04sec | 0.08sec |

DISCUSSION
- SKEWED SHEET AND NON-SKEWED SHEET ARE DIFFERENT IN RESPECTIVE MONITORING ELEMENTS.
- PARTICULARLY, WHEN A MONITORING ELEMENT IS A HALF VALUE WIDTH, DIFFERECE BETWEEN SKEWED SHEET AND NON-SKEWED SHEET IS SIGNIFICANT REGARDLESS OF PAPER TYPE

TRANSPORT MONITORING CONTROL DEVICE AND IMAGE FORMING APPARATUS

CROSS-REFERENCE TO RELATED APPLICATIONS

This application is based on and claims priority under 35 USC 119 from Japanese Patent Application No. 2016-157984 filed Aug. 10, 2016.

BACKGROUND

Technical Field

The present invention relates to a transport monitoring control device and an image forming apparatus.

SUMMARY

According to an aspect of the invention, a transport monitoring control device includes a transport unit configured to transport a recording medium while nipping the recording medium, a driving unit configured to drive the transport unit, a detector configured to detect a waveform related to a load of the driving unit when the recording medium enters the transport unit or is discharged from the transport unit, and a determining unit configured to determine whether the recording medium is skewed with respect to the transport unit, based on a waveform width at a height obtained by multiplying a peak value of the waveform by a predetermined coefficient.

BRIEF DESCRIPTION OF THE DRAWINGS

Exemplary embodiments of the present invention will be described in detail based on the following figures, wherein:

FIG. 11C is a table indicating a relationship between motor driving current characteristic diagrams of FIGS. 11A and 11B and monitoring elements according to the examples of the first and second exemplary embodiments (including modifications).

DETAILED DESCRIPTION

First Exemplary Embodiment

Figure 1:
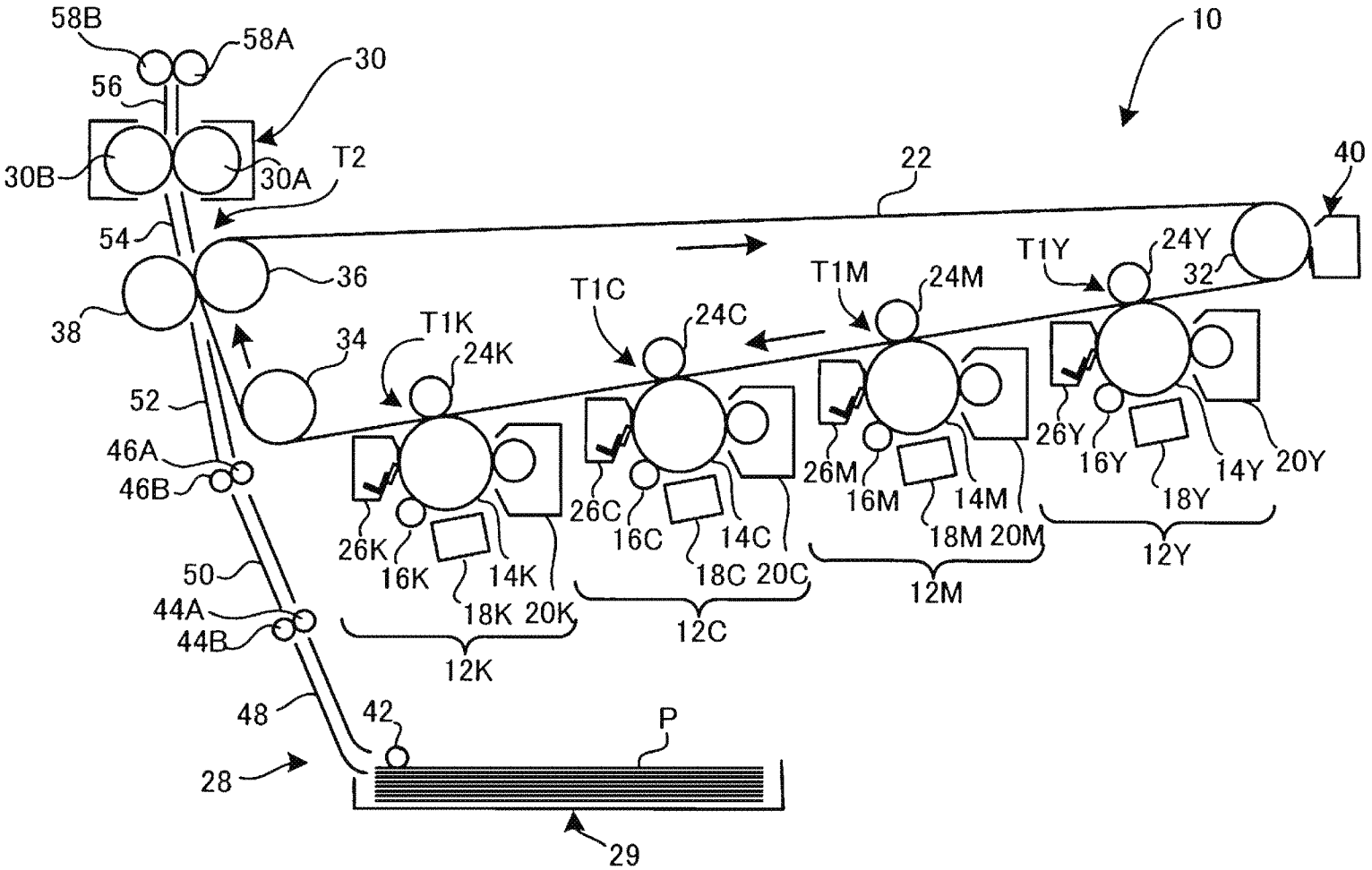
FIG. 1 is a front view illustrating an image forming apparatus according to a first exemplary embodiment.

FIG. 1 is a schematic configuration view illustrating an image forming apparatus 10 according to a first exemplary embodiment.

The image forming apparatus 10 is capable of forming an image in full-color using a quadruple tandem system (image forming may be referred to as "printing"), in which first to fourth electrophotographic image forming units 12Y, 12M, 12C, and 12K, each of which is an example of an image forming unit, are arranged at predetermined intervals in this order from the upstream side to output images of colors of yellow (Y), magenta (M), cyan (C), and black (K).

Hereinafter, the first image forming unit 12Y, the second image forming unit 12M, the third image forming unit 12C, and the fourth image forming unit 12K in the quadruple tandem have the same configurations, and thus may be collectively referred to as "image forming units 12." When the respective components of the image forming units 12 are not distinguished in description, the ends ("Y," "M," "C," and "K") of reference numerals of the respective components described in the drawings may be omitted.

Each image forming unit 12 includes a drum-type photoconductor drum 14 having a photoconductive layer on the surface thereof, a charging roller 16 configured to uniformly charge the photoconductor drum 14, an exposure unit 18 configured to emit an image light to the uniformly charged photoconductor drum 14 to form an electrostatic latent image, a developing unit 20 configured to transfer a toner to the latent image to form a toner image, and a cleaning unit 26 configured to remove a toner remaining on the photoconductor drum 14 after the transfer.

The image forming apparatus 10 includes an intermediate transfer belt 22 having an endless belt shape and serving as an image carrier, which is stretched to circulate through a path coming in contact with the photoconductor drum 14 of each of the image forming units 12 in the quadruple tandem, and a primary transfer roller 24 which transfers the toner image formed on the photoconductor drum 14 to the intermediate transfer belt 22. An area where the photoconductor drum 14 faces the primary transfer roller 24 is referred to as a primary transfer section T1.

The image forming apparatus 10 includes a recording sheet transport mechanism 28 as an example of a transport unit, configured to transport a recording sheet P accommodated in a sheet tray 29, and a fixing unit 30 configured to fix the toner image on the recording sheet P.

The fixing unit 30 includes a heating roller 30A and a pressure roller 30B driven by a driving force of a fixing motor 200 (see e.g., FIG. 3) as a driving unit.

The intermediate transfer belt 22 is wound around a drive roller 32 rotationally driven by a transfer motor 202 (see, e.g., FIG. 3) as a driving unit, a tension roller 34 configured to adjust tension, and a backup roller 36 as an opposing member. The primary transfer roller 24 is disposed inside the intermediate transfer belt 22.

A secondary transfer roller 38 is provided at a position facing the backup roller 36 across the intermediate transfer belt 22. The secondary transfer roller 38 serves as a transfer member that transfers the toner image on the intermediate transfer belt 22 to the recording sheet P transported by the recording sheet transport mechanism 28. An area where the backup roller 36 faces the secondary transfer roller 38 is referred to as a secondary transfer section T2.

A toner remover 40 is provided at a position facing the drive roller 32 across the intermediate transfer belt 22. The toner remover 40 is configured to remove a toner remaining on the intermediate transfer belt 22 after the toner image is transferred to the recording sheet P by the secondary transfer roller 38.

The recording sheet transport mechanism 28 includes a pickup roller 42 configured to take out the uppermost recording sheet P accommodated in the sheet tray 29, feed rollers 44A and 44B driven by a driving force of a feed motor 204 (see, e.g., FIG. 3) as a driving unit and configured to feed the taken-out recording sheet P to the secondary transfer section T2, registration rollers 46A and 46B driven by a driving force of a registration motor 206 (see, e.g., FIG. 3) as a driving unit, and configured to determine a relative position between the image on the intermediate transfer belt 22 and the recording sheet P, paper guides 48, 50, 52, 54 and 56 configured to guide a transport path, sheet discharge rollers 58A and 58B driven by a driving force of a sheet discharge motor 208 (see, e.g., FIG. 3) as a driving unit, an output tray (not illustrated), and the like.

In FIG. 1, one stage of sheet tray 29 is illustrated. However, when plural stages of sheet trays 29 are present, pickup rollers and transport rollers are added according to the number of stages.

Although not illustrated, a reversing mechanism capable of executing duplex printing may be provided in which the sheet discharge rollers 58A and 58B are rotationally driven in a reverse direction to reverse the front and back surfaces of the recording sheet P, and the recording sheet P is returned to the upstream side of the registration rollers 46A and 46B.

The recording sheet transport mechanism 28 transports the recording sheet P accommodated in the sheet tray 29 to the secondary transfer section T2 where the secondary transfer roller 38 and the backup roller 36 face each other across the intermediate transfer belt 22, transports the recording sheet P from the secondary transfer section T2 to the fixing unit 30, and then transports the recording sheet P from the fixing unit 30 to an output tray.

(Engine Unit Control System)

Figure 2:
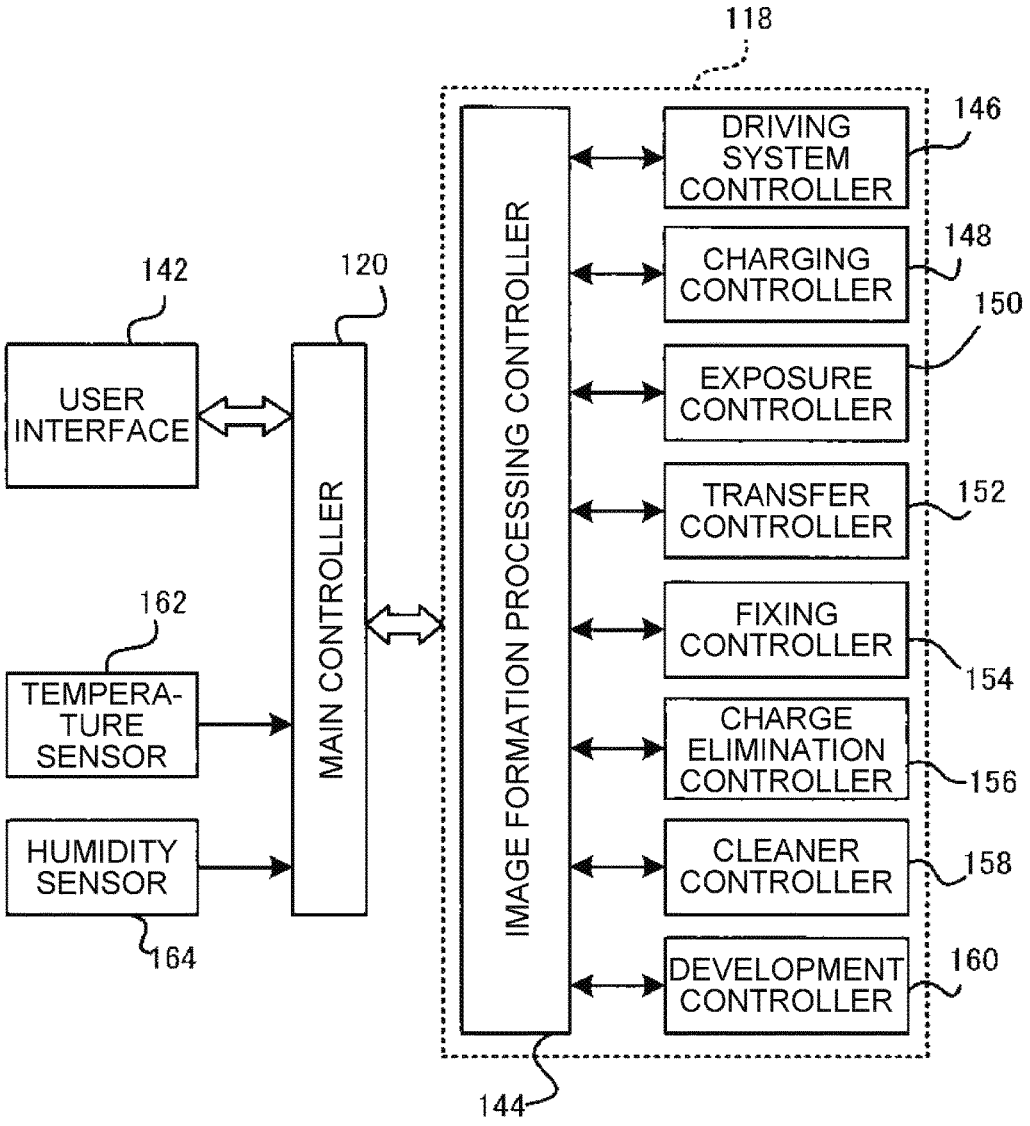
FIG. 2 is a control block diagram illustrating an image formation processing engine of the image forming apparatus according to the first exemplary embodiment.

FIG. 2 is a block diagram illustrating an example of a control system of the image forming apparatus 10.

A main controller 120 as a main control function of the image forming apparatus 10 is connected to a user interface 142. The user interface 142 includes an input unit through which an instruction related to image formation or the like is input, and an output unit through which information such as image formation or the like is notified by display or voice.

The main controller 120 is connected to a communication network with an external host computer (not illustrated), and image data is input to the main controller 120 through the communication network.

When image data is input, the main controller 120 analyzes, for example, print instruction information and images included in the image data, converts the image data into data with a format suitable for the image forming apparatus 10 (e.g., raster image data), and sends the converted image data to an image formation processing controller 144 serving as a part of an MCU 118.

Based on the input image data, the image formation processing controller 144 synchronously controls each of a driving system controller 146, a charging controller 148, an exposure controller 150, a transfer controller 152, a fixing controller 154, a charge elimination controller 156, a cleaner controller 158, and a development controller 160, each of which serves as an MCU 118, together with the image formation processing controller 144, and executes image formation. In FIG. 2, functions executed by the MCU 118 are classified into blocks and illustrated, and the hardware configuration of the MCU 118 is not limited thereto.

Further, the main controller 120 is connected to a temperature sensor 162, a humidity sensor 164, and the like, and may detect the ambient temperature and humidity within the housing of the image forming apparatus 10 based on the temperature sensor 162 and the humidity sensor 164.

Figure 3:
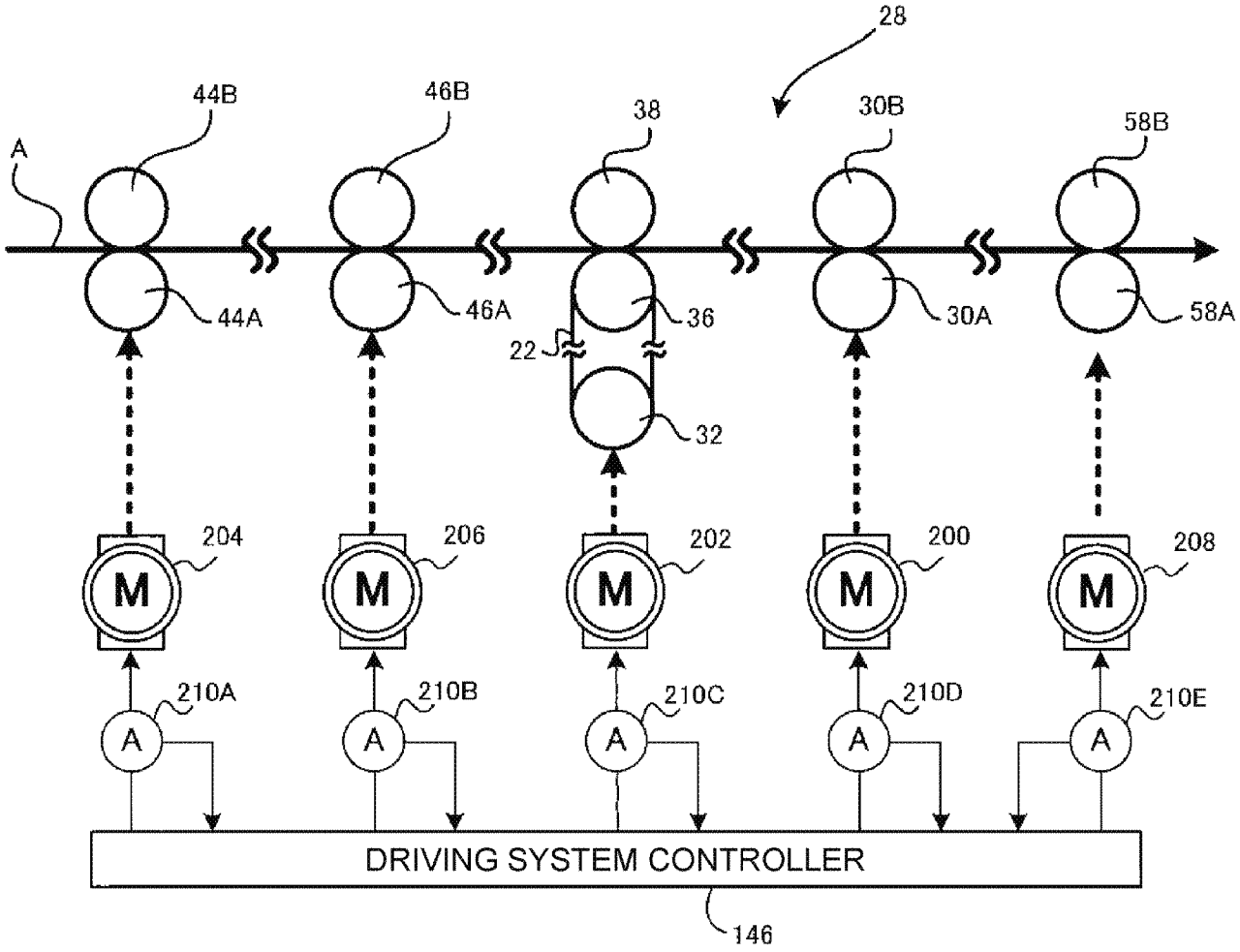
FIG. 3 is a front view equivalently illustrating a relative positional relationship between portions applying a transport force to a recording sheet in a recording sheet transport mechanism of the image forming apparatus in FIG. 1.

FIG. 3 is a front view of a transport system equivalently illustrating a relative positional relationship between portions (the feed rollers 44, the registration rollers 46, the intermediate transfer belt 22, the fixing unit 30, and the sheet discharge rollers 58) provided along the recording sheet transport mechanism 28 and applying a transport force to the recording sheet P.

The driving system controller 146 controls the driving of driving sources including the feed motor 204, the registration motor 206, the transfer motor 202, the fixing motor 200, and the sheet discharge motor 208.

A transport force is imparted to the recording sheet P from the feed rollers 44, the registration rollers 46, the intermediate transfer belt 22, the fixing unit 30, and the sheet discharge rollers 58 in this order from the left side in the transport path indicated by the arrow A in FIG. 3.

In addition, in the secondary transfer section T2, the transport force is imparted to the recording sheet P as the recording sheet P is nipped between the intermediate transfer belt 22 operated by a driving force of the drive roller 32 and the secondary transfer roller 38. In addition, in the fixing unit 30, the transport force is imparted to the recording sheet P as the recording sheet P is nipped between the heating roller 30A and the pressure roller 30B.

Current detectors 210A to 210E are interposed in power supply lines for driving the feed motor 204, the registration motor 206, the transfer motor 202, the fixing motor 200, and the sheet discharge motor 208. In the following specification, the current detectors 210A to 210E may be collectively referred to as a current detector 210.

The current value detected by each of the current detectors 210 is output to the driving system controller 146.

Here, basic functions of respective portions illustrated in FIG. 3 in the transport of the recording sheet P are the same. As illustrated in FIGS. 4B and 4C, in each of the portions, when the recording sheet P is nipped by a pair of rollers 212, in which one serves as a driving roller 212A driven by a driving force of a motor 214, and the other serves as a follower roller 212B. The pair of rollers 212 impart a transport force to the recording sheet P by nipping the recording sheet P therebetween.

That is, the driving roller 212A corresponds to the feed roller 44A, the registration roller 46A, the intermediate transfer belt 22, the heating roller 30A, and the sheet discharge roller 58A in FIGS. 1 and 3, and the follower roller 212B corresponds to the feed roller 44B, the registration roller 46B, the secondary transfer roller 38, the pressure roller 30B, and the sheet discharge roller 58B in FIGS. 1 and 3.

The motor 214 corresponds to the feed motor 204, the registration motor 206, the transfer motor 202, the fixing motor 200, and the sheet discharge motor 208 which are driven and controlled by the driving system controller 146 (see, e.g., FIG. 3).

Hereinafter, portions in the recording sheet transport mechanism 28 which impart a transport force to the recording sheet P may be collectively referred to as the pair of rollers 212 (the driving roller 212A, the follower roller 212B) and the motor 214 based on FIGS. 4B and 4C without being distinguished.

(Motor Load Principle and Skew Detection)

Figure 4A:
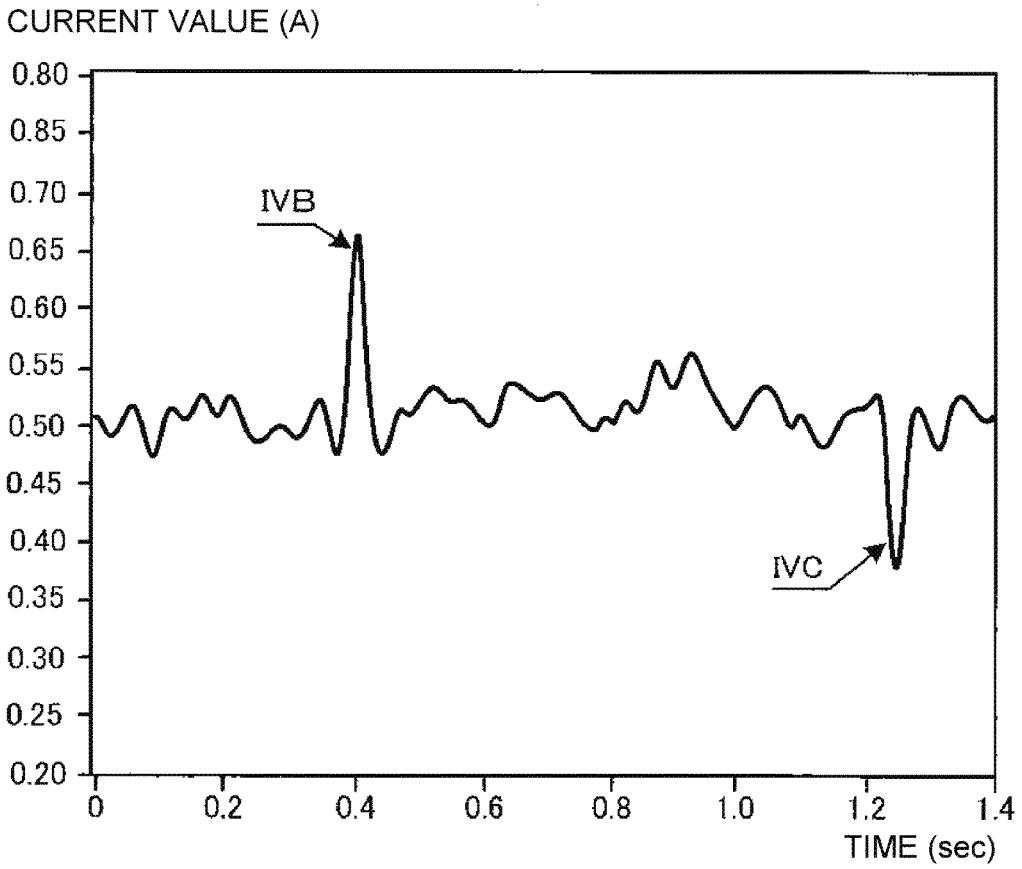
FIG. 4A is a driving current value characteristic curve of a motor that drives a pair of rollers.
Figure 4B:
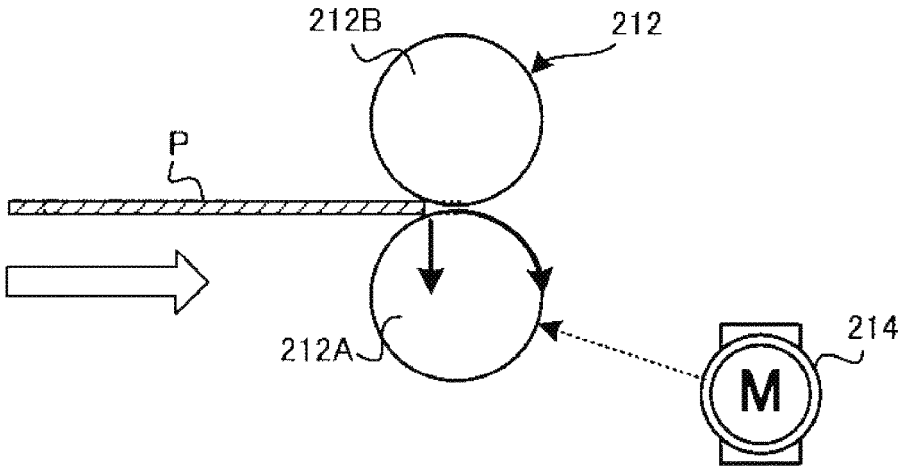
FIG. 4B is a front view when a recording sheet enters the pair of rollers.
Figure 4C:
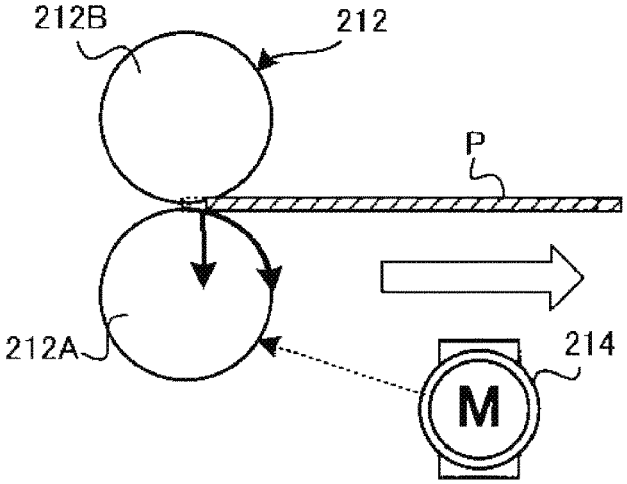
FIG. 4C is a front view when the recording sheet is discharged from the pair of rollers.

FIG. 4A is a characteristic diagram illustrating a current value of the motor 214 when a recording sheet P is nipped between the pair of rollers 212.

When the motor 214 is driven, a current value changes within a specific range (around 0.5 A in FIG. 4A). When the leading end of the recording sheet P reaches the pair of rollers 212 (see, e.g., FIG. 4B), a load to the motor 214 is increased, and a current occurs in which the current value protrudes toward the plus side (0.65 A in FIG. 4A).

When the pinching of the recording sheet P is completed, the current value of the motor 214 is stabilized (around 0.5 A in FIG. 4A).

Meanwhile, when the trailing end portion of the recording sheet P is separated from the pair of rollers 212 (see, e.g., FIG. 4C), the load to the motor 214 is decreased, and a current occurs in which the current value protrudes toward the negative side (0.4 A in FIG. 4A).

Figure 5A:
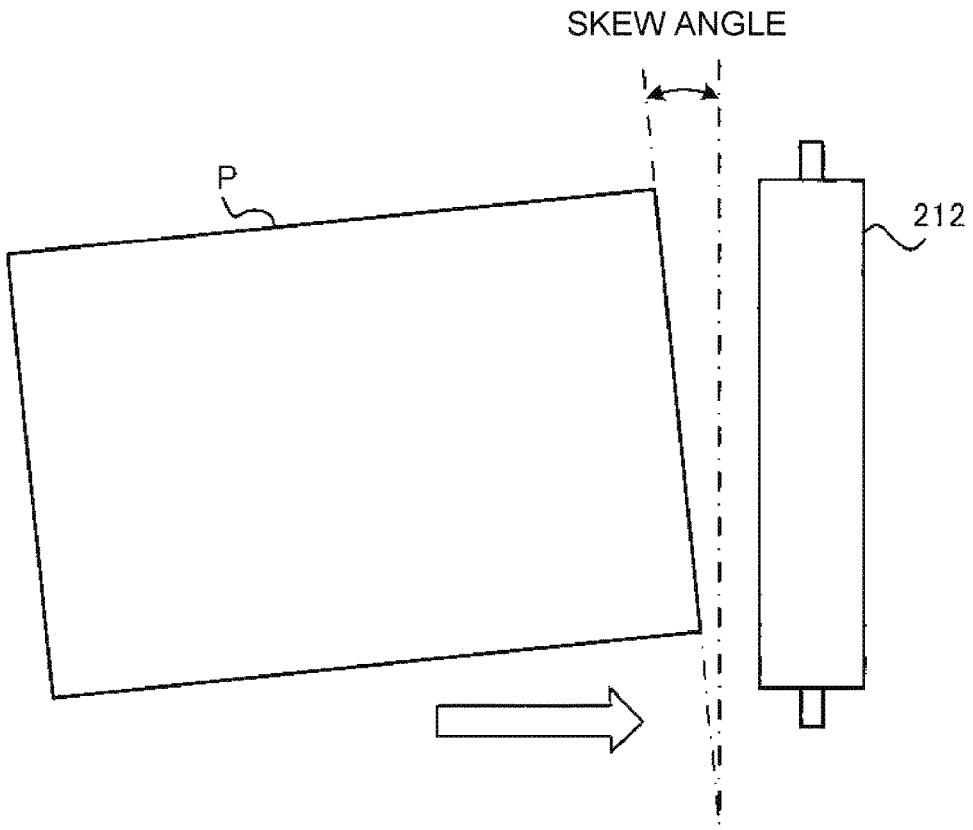
FIG. 5A is a plan view illustrating a skew angle when a recording sheet is skewed and enters a pair of rollers.

Here, as illustrated in FIG. 5A, when the recording sheet P is skewed, the recording sheet P is gradually nipped between the pair of rollers 212 from one end of the recording sheet P in a width direction intersecting the transport direction to the other end of the recording sheet P.

That is, the skewed recording sheet P is gradually nipped between the pair of rollers 212, as compared to the non-skewed recording sheet P, and thus, a peak current value is small, and a sharpness becomes dull.

Figure 5B:
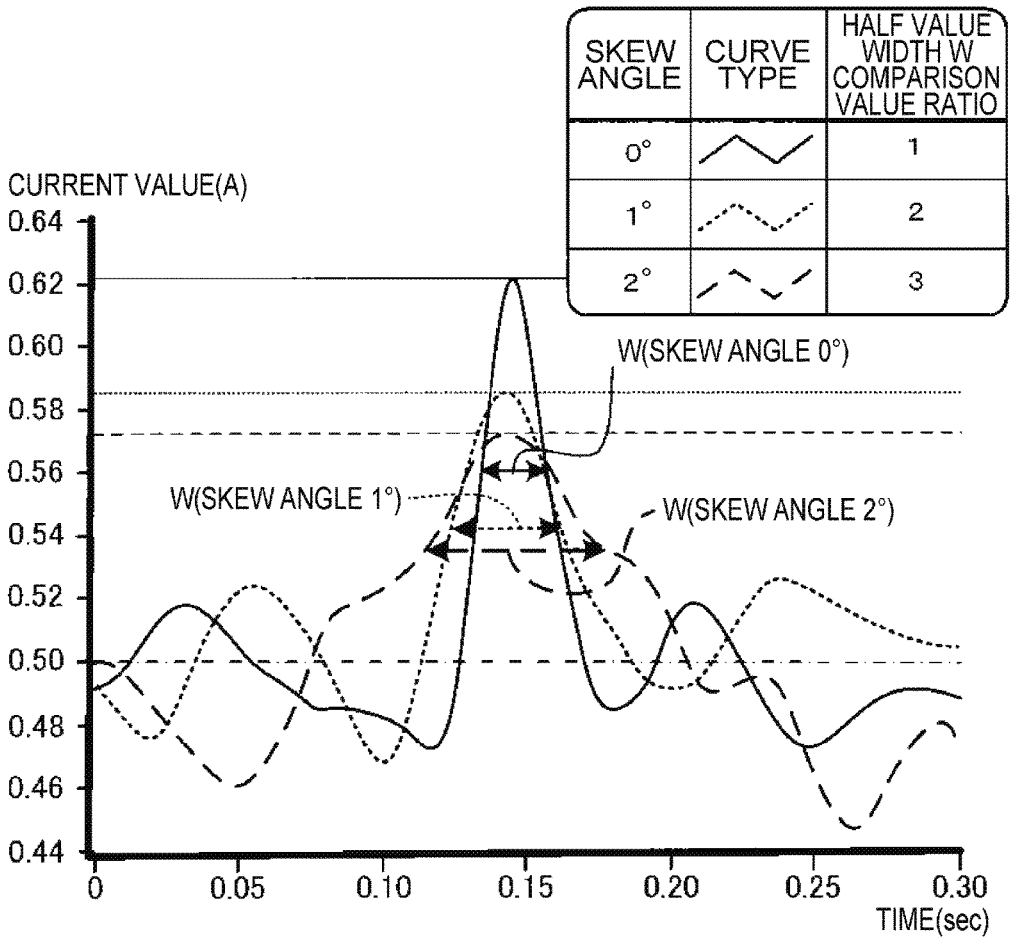
FIG. 5B is a driving current value characteristic curve of a motor that drives the pair of rollers according to a skew angle.

FIG. 5B illustrates a characteristic curve of a peak current value in a case where a skewed recording sheet P (with a skew angle of 1° or 2°) is transported, with respect to a non-skewed recording sheet P (skew angle 0°).

As illustrated in FIG. 5B, it may be found that a peak current value varies due to the skew angle. However, the peak current value may depend on other requirements (e.g., the paper type including the thickness of the recording sheet P).

Meanwhile, as illustrated in FIG. 5B, it may be found that, for example, a half-value width of each characteristic curve (that is, the width (time) of a position corresponds to half the peak current value) varies according to a skew angle. The half-value width is a value at which a ratio with respect to a half-value width of the non-skewed recording sheet P is determined by a skew angle without depending on other requirements. The half-value width is an example of a waveform width at a height obtained by multiplying a peak value of a waveform by a predetermined coefficient.

The half-value width may be generally a "full width at half maximum" (FWHM) and "half width at half maximum" (HWHM) as the half value of the FWHM. Hereinafter, FWHM is used. In the present exemplary embodiment, the half-value width (full width at half maximum) is employed as a waveform width at a height obtained by multiplying a peak value of a waveform by a predetermined coefficient. However, the predetermined coefficient is not limited to ½, but may be theoretically in a range of 0<predetermined coefficient <1.

That is, from FIG. 5B, it is found that regardless of other requirements, the half-value width of the characteristic curve with a skew angle of 1° is twice the half-value width in a case where no skew occurs, and the half-value width of the characteristic curve with a skew angle of 2° is three times the half-value width in a case where no skew occurs.

Figure 6:
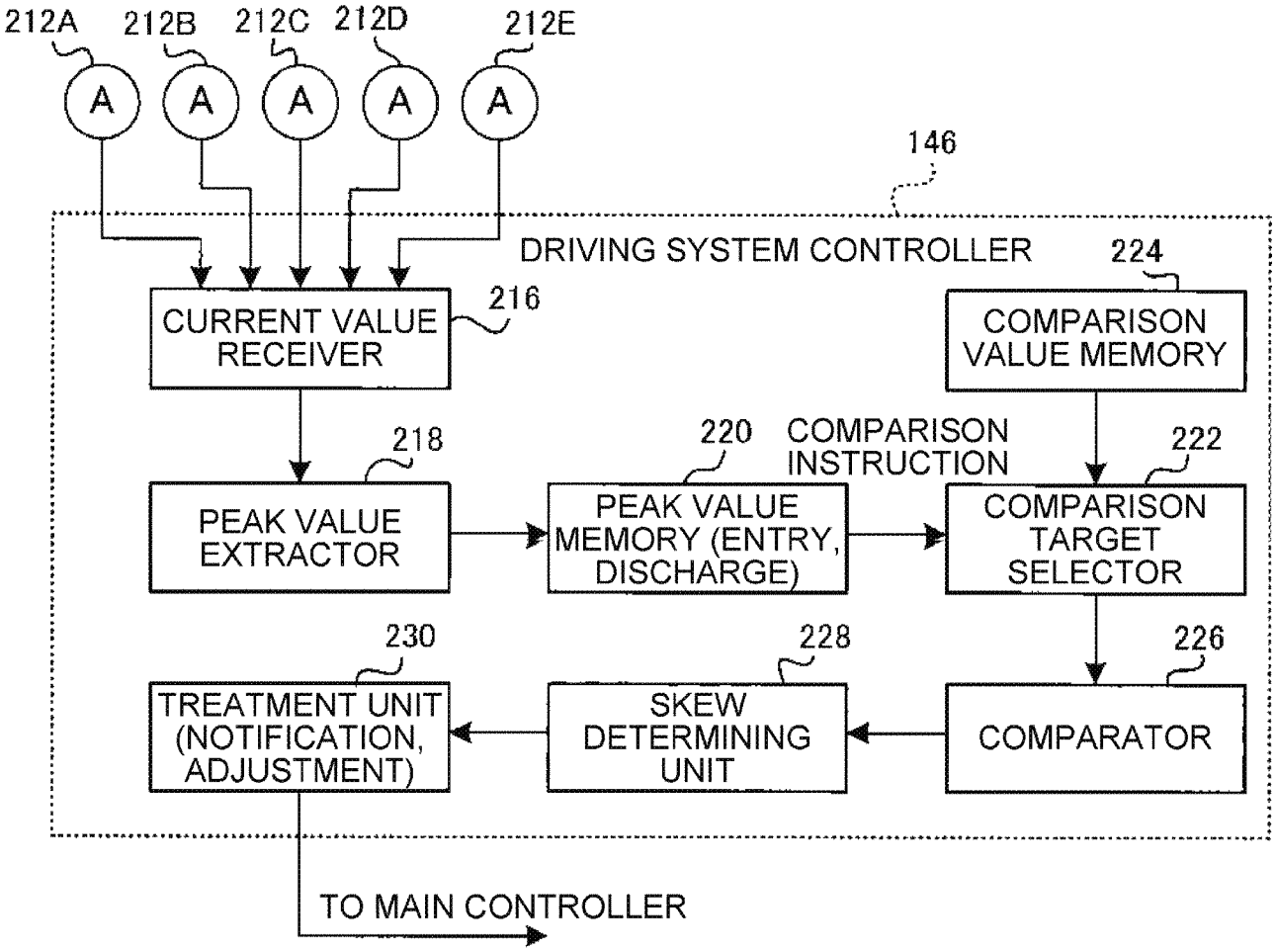
FIG. 6 is a block diagram specialized for a function executed by a driving system controller, that is, a function for executing the monitoring of the skew of a recording sheet, according to a first exemplary embodiment.

FIG. 6 is a block diagram specialized for a function executed by the driving system controller 146, that is, a function for executing the monitoring of the skew of a recording sheet P. The hardware configuration of the driving system controller 146 is not limited to the respective blocks of FIG. 6.

The skew monitoring function may be executed by the image formation processing controller 144 or the main controller 120 illustrated in FIG. 2 regardless of the driving system controller 146. A dedicated control device having a skew monitoring function may be newly mounted or connected to the image forming apparatus 10.

As illustrated in FIG. 6, the current detectors 210A to 210E connected to the power supply line of each motor 214 (see, e.g., FIG. 3) are connected to a current value receiver 216.

The current value receiver 216 is connected to a peak value extractor 218 as an example of a detector, and sends the received current value to the peak value extractor 218.

The peak value extractor 218 monitors the received current value on the time axis, and extracts a peak value (a peak current value). As illustrated in FIGS. 4A to 4C, during the transport of the recording sheet P, peak current values occur when the recording sheet P enters the pair of rollers 212 and when the recording sheet P is discharged from the pair of rollers 212. The peak value extractor 218 extracts a sheet entry current (current when a sheet enters) and a sheet discharge current (current when a sheet is discharged), within a predetermined time zone centered on each of the peak values.

The peak value extractor 218 is connected to a peak value memory 220. The peak value memory 220 stores the sheet entry current and the sheet discharge current extracted by the peak value extractor 218.

The peak value memory 220 is connected to a comparison target selector 222, and outputs a comparison instruction when, for example, the extraction of the sheet entry current and the sheet discharge current for one recording sheet P is ended.

A comparison value memory 224 is connected to the comparison target selector 222. The comparison value refers to a preset threshold value used for comparison to the extracted sheet entry current or the extracted sheet discharge current. The threshold value corresponds to a sheet entry current or a sheet discharge current when the recording sheet P is not skewed.

The comparison target selector 222 selects two from among the sheet entry current, the sheet discharge current, and a comparison value, as comparison targets. In the first exemplary embodiment, each sheet entry current and a comparison value are selected and compared to each other.

As will be described in detail in modifications, when a sheet entry current and a sheet discharge current at one pair of rollers 212 are selected (see, e.g., first modification) or when sheet entry currents at two pairs of rollers are compared (see, e.g., second modification), targets to be selected by the comparison target selector 222 may be changed.

Alternatively, plural types of comparison targets may be selected and processed in parallel (a combination of the first exemplary embodiment and a comparative example).

The comparison target selector 222 is connected to a comparator 226, and sends the selected comparison target to the comparator 226.

The comparator 226 compares comparison targets to each other. That is, in the first exemplary embodiment, the comparator 226 calculates a half-value width W based on a sheet entry current when the comparison targets are a sheet entry current and a threshold value.

The half-value width W is a width (time) of a time axis corresponding to ½ of a peak value H. The threshold value Ws is a preset half-value width in a case where no skew occurs. Accordingly, the comparator 226 compares the calculated value W to the threshold value Ws.

The comparison result from the comparator 226 is sent to a skew determining unit 228 as an example of a determining unit. The skew determining unit 228 determines at least whether a skew is present based on a difference between the calculated value W and the threshold value Ws, and determines, as necessary, a skew amount (skew angle) when a skew is present.

The skew determining unit 228 is connected to a treatment unit 230 serving as either a notifying unit, or one or both of a discrimination unit and an adjusting unit. The treatment unit 230 sends, for example, notification information that notifies the main controller 120 (see, e.g., FIG. 2) of the occurrence of a skew during the transport of the recording sheet P through the image formation processing controller 144 (see, e.g., FIG. 2). A wiring for directly transmitting the notification information may be implemented from the driving system controller 146 to the main controller 120.

The main controller 120 notifies of the occurrence of a skew in the recording sheet P by controlling a user interface 142 (see, e.g., FIG. 2).

The treatment unit 230 may execute an adjustment instruction for eliminating a skew (see, e.g., a second exemplary embodiment).

Hereinafter, the operation of the first exemplary embodiment will be described.

(Flow of Normal Image Formation Processing Mode)

The image forming units 12 have substantially the same configuration. Thus, hereinafter, a first image forming unit 12Y configured to form a yellow image and disposed upstream in the traveling direction of the intermediate transfer belt 22 will be representatively described. By assigning the same reference numerals with magenta (M), cyan (C), and black (K) instead of yellow (Y) to members having the same function as the first image forming unit 12Y, descriptions on the second to fourth image forming units 12M, 12C, and 12K will be omitted.

First, prior to the operation, the rotation of the photoconductor drum 14Y is initiated. Thereafter, the surface of the photoconductor drum 14Y is applied with superimposed voltage of DC and AC by the charging roller 16Y in the first exemplary embodiment, and is charged to a predetermined potential. In general, the predetermined potential may be selected from a range of from −400 V to −800 V. In order to charge, for example, the photoconductor drum 14Y, a voltage obtained by superimposing an AC voltage with a specific amplitude Vpp and a specific frequency f on a DC voltage is applied to the charging roller 16Y.

The photoconductor drum 14Y is formed so that a photosensitive layer is stacked on a conductive metal base body. The photoconductor drum 14Y has a property that the resistance thereof is normally high, but when the photoconductor drum 14Y is irradiated with LED light, the resistance of the portion irradiated with the LED lays is changed.

Therefore, in the MCU 118, a light beam (e.g., LED light) for exposure is output by the exposure unit 18Y to the charged surface of the photoconductor drum 14Y according to image data for yellow sent from the main controller 120. The light beam is emitted to the photosensitive layer on the surface of the photoconductor drum 14Y, and thus, an electrostatic latent image with a yellow printing pattern is formed on the surface of the photoconductor drum 14Y.

The electrostatic latent image refers to an image formed on the surface of the photoconductor drum 14Y due to charging, that is, a so-called negative latent image formed when the specific electric resistance of an irradiated portion of the photosensitive layer is lowered by the light beam, and thus electric charges charged on the surface of the photoconductor drum 14Y flow, while electric charges on the portion not irradiated with the light beam remain.

In this manner, the electrostatic latent image formed on the photoconductor drum 14Y is rotated to a developing position due to the rotation of the photoconductor drum 14Y. Then, at the developing position, the electrostatic latent image on the photoconductor drum 14Y is converted into a visible image (toner image) by the developing unit 20Y.

In the developing unit 20Y, a yellow toner produced by an emulsion polymerization method is accommodated. The yellow toner is frictionally electrified by being agitated inside the developing unit 20Y, and has electric charges of the same polarity (−) as the electric charges on the surface of the photoconductor drum 14Y.

As the surface of the photoconductor drum 14Y passes through the developing unit 20Y, the yellow toner electrostatically adheres to only the neutralized latent image portion on the surface of the photoconductor drum 14Y, and the latent image is developed with the yellow toner.

The photoconductor drum 14Y continuously rotates so that the toner image developed on the surface of the photoconductor drum 14Y is transported to the primary transfer section T1. When the yellow toner image on the surface of the photoconductor drum 14Y is transported to the primary transfer section, a primary transfer bias is applied to the primary transfer roller 24Y. Then, the electrostatic force directed to the primary transfer roller 24Y from the photoconductor drum 14Y acts on the toner image, and the toner image on the surface of the photoconductor drum 14Y is transferred to the surface of the intermediate transfer belt 22.

Here, the transfer bias to be applied has a (+) polarity opposite to the polarity (−) of the toner, and is controlled to, for example, be a constant current ranging from about +20 to +30 μA by the transfer controller 152 in the first image forming unit 12Y.

Meanwhile, the toner remaining on the surface of the photoconductor drum 14Y after the transfer is cleaned by the cleaning unit 26Y.

The primary transfer bias to be applied to the primary transfer rollers 24M, 24C, and 24K subsequently to the second image forming unit 12M is also controlled in the same manner as described above.

In this manner, the intermediate transfer belt 22 transferred with the yellow toner image in the first image forming unit 12Y is sequentially transported through the second to fourth image forming units 12M, 12C, and 12K, and the toner images of respective colors are similarly superimposed and transferred in a superimposed manner.

The intermediate transfer belt 22 on which toner images of all colors are transferred in the superimposed manner by all of the image forming units 12 is circumferentially transported in the arrow direction, and reaches the secondary transfer section T2 configured with the backup roller 36 coming in contact with the inner surface of the intermediate transfer belt 22 and the secondary transfer roller 38 disposed at the image carrying surface side of the intermediate transfer belt 22.

Meanwhile, the recording sheet P is fed to a gap between the secondary transfer roller 38 and the intermediate transfer belt 22 at a predetermined timing by a supply mechanism, and a secondary transfer bias is applied to the secondary transfer roller 38.

Here, the transfer bias to be applied has a (+) polarity opposite to the polarity (−) of the toner, the electrostatic force toward the recording sheet P from the intermediate transfer belt 22 acts on the toner image, and the toner image on the surface of the intermediate transfer belt 22 is transferred to the surface of the recording sheet P.

Thereafter, the recording sheet P is sent to the fixing unit 30 and the toner image is heated and pressurized, so that the color-superimposed toner image is melted and permanently fixed to the surface of the recording sheet P. The recording sheet P on which a color image has been fixed is transported toward a discharge unit, and a series of color image formation operations are completed.

(Skew Monitoring Control)

Figure 7:
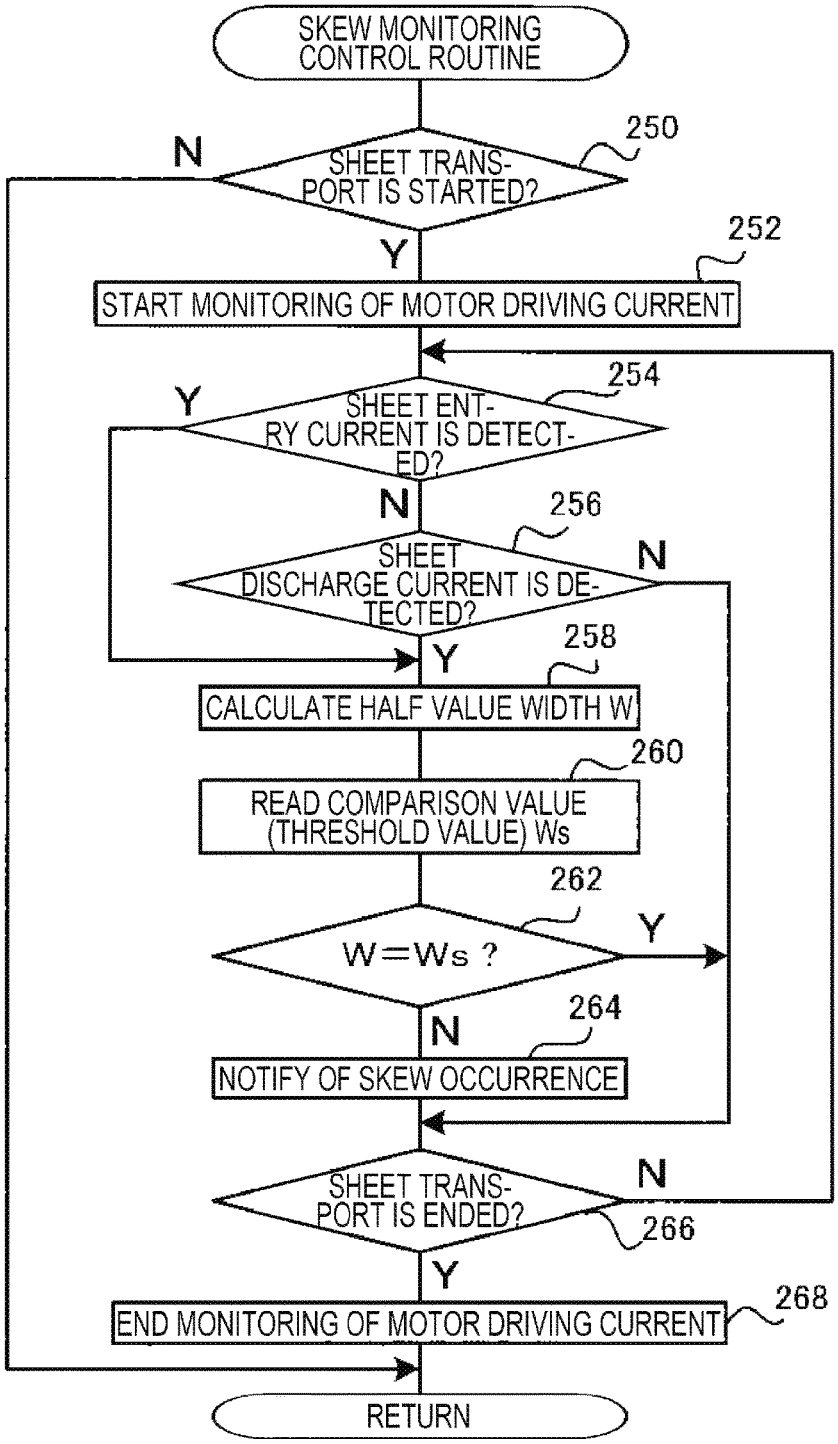
FIG. 7 is a flow chart illustrating a skew monitoring control routine of a recording sheet, which is executed by the driving system controller according to the first exemplary embodiment.

FIG. 7 is a flow chart illustrating a skew monitoring control routine of a recording sheet P, which is executed by the driving system controller 146 according to the first exemplary embodiment.

In step 250, it is determined whether the transport of the recording sheet P is started. When a negative determination is made, this routine is ended.

When an affirmative determination is made in step 250, the process proceeds to step 252 to start the monitoring of a motor driving current.

Next, in step 254, it is determined whether a sheet entry current is detected. When an affirmative determination is made in step 254, the process proceeds to step 258. The term "sheet entry current" as referred to herein means a current value in a predetermined period of time centered on a peak current value at the time of sheet entry (see, a driving current value characteristic illustrated in FIG. 4A, and FIG. 4B).

When a negative determination is made in step 254, the process proceeds to step 256 to determine whether a sheet discharge current is detected. When an affirmative determination is made in step 256, the process proceeds to step 258. The term "sheet discharge current" as referred to herein means a current value in a predetermined period of time centered on a peak current value at the time of sheet discharge (see, a characteristic illustrated in FIG. 4A, and FIG. 4C).

In the first exemplary embodiment, since a comparison with a comparison value (threshold value) is made, it is sufficient to detect either a sheet entry current or a sheet discharge current.

In step 258, a half-value width W of the detected current value (the sheet entry current or the sheet discharge current) is calculated, and the process proceeds to step 260.

In step 260, a comparison value (threshold value) Ws is read, and then the process proceeds to step 262 so that the calculated half-value width W and the comparison value (threshold value) Ws are compared to each other.

When determination of W # Ws (i.e., negative determination) is made in step 262, it is determined that a skew has occurred in the transport of the recording sheet P, and the process proceeds to step 264. The skew occurrence is notified and the process proceeds to step 266.

When determination of W=Ws (i.e., affirmative determination) is made, it is determined that no skew has occurred in the transport of the recording sheet P, and the process proceeds to step 266.

In step 266, it is determined whether the transport of the recording sheet P is ended (whether the image formation processing is ended). When a negative determination is made, the process proceeds back to step 254 and the above described steps are repeated.

When an affirmative determination is made in step 266, the process proceeds to step 268. The monitoring of the motor driving current is ended and this routine is ended.

Second Exemplary Embodiment

Hereinafter, the second exemplary embodiment will be described. In the first exemplary embodiment, when it is discriminated that a skew has occurred in the transport of the recording sheet P, notification is made. Meanwhile, in the second exemplary embodiment, a mechanism for adjusting a skew is provided.

Figure 8A:
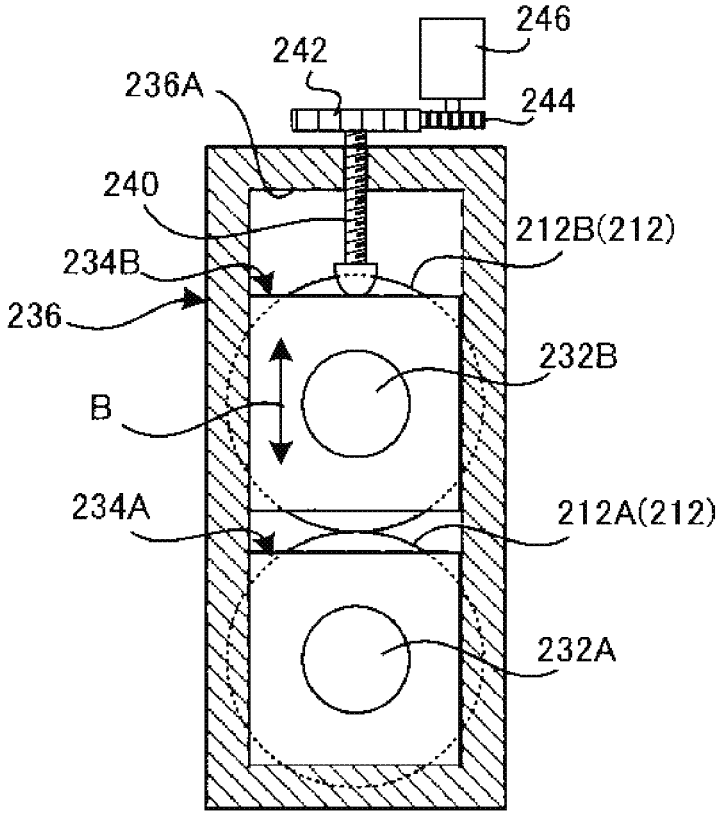
FIG. 8A is a front view illustrating a mechanism of applying a load to bearings of a pair of rollers, according to a second exemplary embodiment.

As illustrated in FIG. 8A, the pair of rollers 212 include rotation shafts 232A and 232B, respectively. The rotation shafts 232A and 232B are rotatably supported by bearings 234A and 234B, respectively.

The bearings 234A and 234B are accommodated in a vertically elongated rectangle frame member 236, and the bearing 234A is fixed to the lowermost portion of a rectangle hole 236A of the frame member 236. Meanwhile, the bearing 234B is movable up and down (see, e.g., the arrow B in FIG. 8A) in the rectangle hole 236A.

A female screw shaft 240 is formed at the upper end portion of the frame member 236, through which a male screw shaft 240 is screwed. The lower end portion of the male screw shaft 240 may abut on the bearing 234B, so that the bearing 234B is pressed toward the bearing 234A by the male screw shaft 240. Thus, the driving roller 212A and the follower roller 212B come in contact with each other with a predetermined nip pressure.

The male screw shaft 240 is connected to a rotation shaft of a motor 246 through gears 242 and 244. Thus, by rotation (forward or reverse) of the motor 246, the screwing amount of the male screw shaft 240 may be adjusted. Instead of the male screw shaft 240, an eccentric cam shaft may be applied.

Figure 8B:
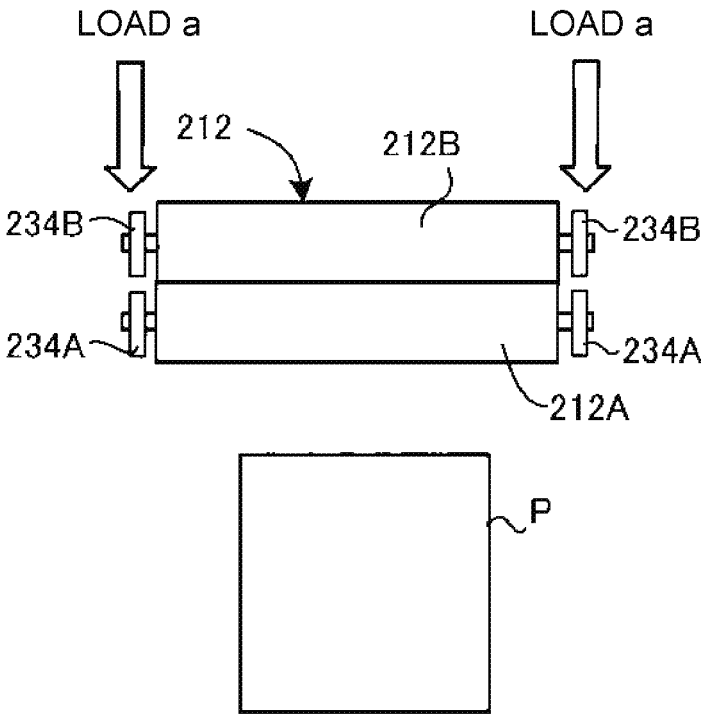
FIG. 8B illustrates a pair of rollers in a normal state where balanced loads are applied to both end portions, according to the second exemplary embodiment.

Here, as illustrated in FIG. 8B, in a normal state where a skew has not occurred in the transport of the recording sheet P, a uniform load is applied to both end portions of the pair of rollers 212 in the axial direction by the male screw shaft 240 as illustrated in FIG. 8A, and a constant nip pressure is applied in the axial direction (load a).

Figure 8C:
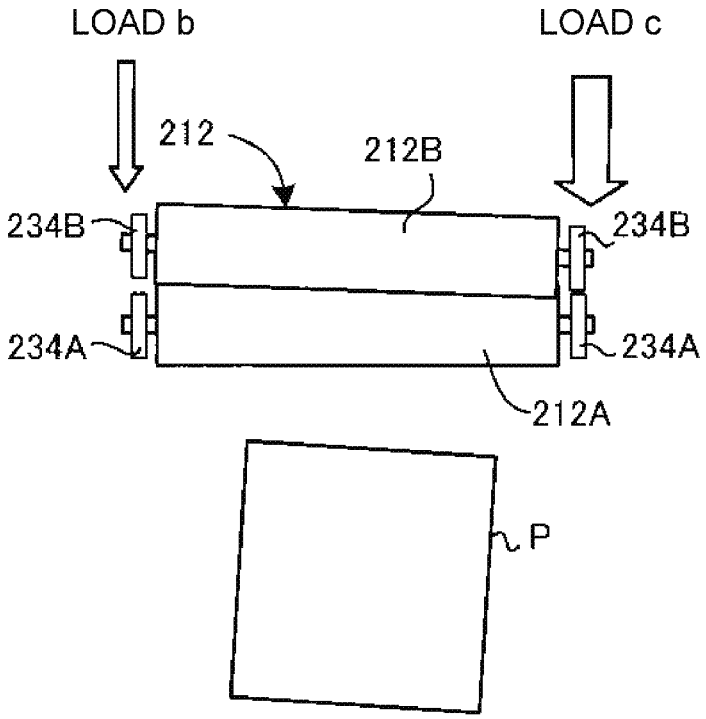
FIG. 8C illustrates a pair of rollers in a skew occurrence state where imbalanced loads are applied to both end portions, according to the second exemplary embodiment.

Meanwhile, as illustrated in FIG. 8C, in an abnormal state where a skew has occurred in the transport of the recording sheet P, a bearing load balance is adjusted by a screwing amount of the male screw shaft 240 illustrated in FIG. 8A according to a skew amount.

For example, as illustrated in FIG. 8C, when the recording sheet P is tilted to the right, loads at both end portions in the axial direction are set to be b<c so that the nip pressure at the right bearings 234A and 234B side is increased.

Hereinafter, the operation of the second exemplary embodiment will be described with reference to the flow chart of FIG. 9.

Figure 9:
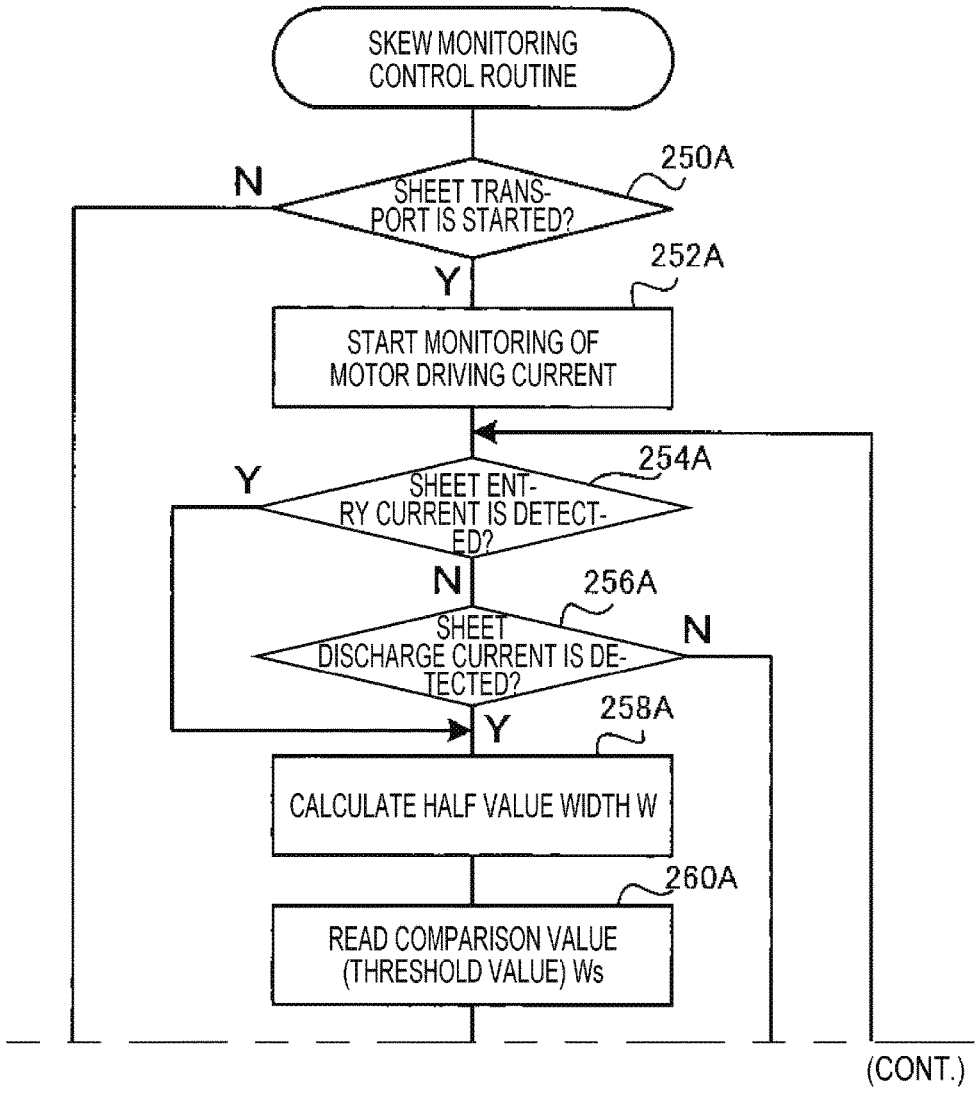
FIG. 9 is a flow chart illustrating a skew monitoring control routine of a recording sheet, which is executed by the driving system controller according to the second exemplary embodiment.

FIG. 9 is a flow chart illustrating a skew monitoring control routine of a recording sheet P, which is executed by the driving system controller 146 according to the second exemplary embodiment. The same processing steps as those of the first exemplary embodiment are assigned the same reference numerals followed by a reference numeral A.

In step 250A, it is determined whether the transport of the recording sheet P is started. When a negative determination is made, this routine is ended.

When an affirmative determination is made in step 250A, the process proceeds to step 252A to start the monitoring of a motor driving current.

Next, in step 254A, it is determined whether a sheet entry current is detected. When an affirmative determination is made in step 254A, the process proceeds to step 258A. The term "sheet entry current" as referred to herein means a current value in a predetermined period of time centered on a peak current value at the time of sheet entry (see, a characteristic illustrated in FIGS. 4A, and 4B).

When a negative determination is made in step 254A, the process proceeds to step 256A to determine whether a sheet discharge current is detected. When an affirmative determination is made in step 256A, the process proceeds to step 258A. The term "sheet discharge current" as referred to herein means a current value in a predetermined period of time centered on a peak current value at the time of sheet discharge (see, a characteristic illustrated in FIG. 4A and FIG. 4C).

In the second exemplary embodiment, since a comparison with a comparison value (threshold value) is made, it is sufficient to detect either a sheet entry current or a sheet discharge current.

In step 258A, a half-value width W of the detected current (the sheet entry current or the sheet discharge current) is calculated, and the process proceeds to step 260A.

In step 260A, a comparison value (threshold value) Ws is read, and then the process proceeds to step 262A so that the calculated half-value width W and the comparison value (threshold value) Ws are compared to each other.

When a determination of W≠Ws (i.e., negative determination) is made in step 262A, it is determined that a skew has occurred in the transport of the recording sheet P, and the process proceeds to step 270.

When a determination of W=Ws (i.e., affirmative determination) is made, it is determined that no skew has occurred in the transport of the recording sheet P, and the process proceeds to step 266A.

In step 270, a ratio of comparison targets is calculated (W/Ws), and then the process proceeds to step 272 to acquire a skew angle based on the ratio of comparison targets (see, e.g., FIG. 5B).

In the following step 274, the skewing direction is determined, and then the process proceeds to step 276. A load balance between the bearings 234A, and 234B is adjusted according to the skew angle (see, e.g., FIG. 8B), and the process proceeds to step 266A.

By the adjustment in step 276, the skewed recording sheet P is changed in direction so that the skew is restored due to imbalance of a load. When discharged from the pair of rollers 212, the recording sheet P may be restored to a normal state.

In step 266A, it is determined whether the transport of the recording sheet P is ended (whether the image formation processing is ended). When a negative determination is made, the process proceeds back to step 254A and the above described steps are repeated.

When an affirmative determination is made in step 266A, the process proceeds to step 268A. The monitoring of the motor driving current is ended and this routine is ended.

(Modification)

Hereinafter, modifications of the first and second exemplary embodiments will be described.

Figure 10A:
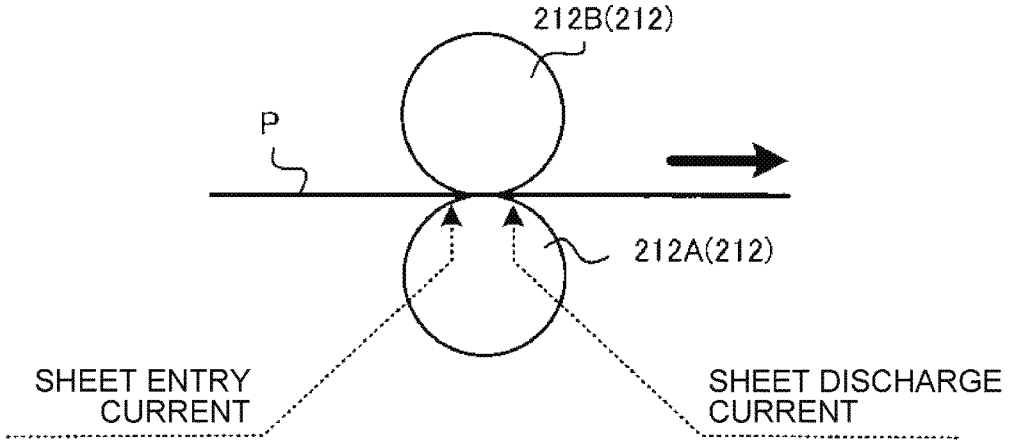
FIG. 10A is a front view of a pair of rollers indicating comparison target extraction places applied in the first and second exemplary embodiments.

In the first and second exemplary embodiments, as illustrated in FIG. 10A, a waveform of a sheet entry current or a sheet discharge current (a waveform in a certain time zone centered on the peak value) as a driving current of the motor 214 of the specific pair of rollers 212 is extracted, and the half-value width of the waveform is compared to a comparison value which is stored in advance (a threshold value conforming to the driving current at the time of normal transport).

Figure 10B:
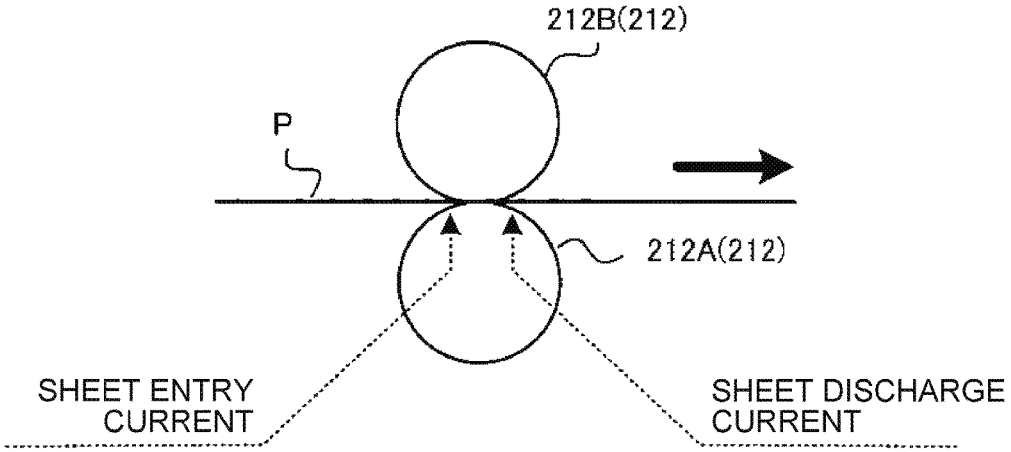
FIGS. 10B and 10C are front views of modified examples of FIG. 10A.

In the first modification, as illustrated in FIG. 10B, the half-value width obtained from the waveform of the sheet entry current of the specific pair of rollers 212 is compared to the half-value width obtained from the waveform of the sheet discharge current of the same specific pair of rollers 212. In this case, it is possible to determine whether the recording sheet P is skewed when nipped between the specific pair of rollers 212.

Figure 10C:
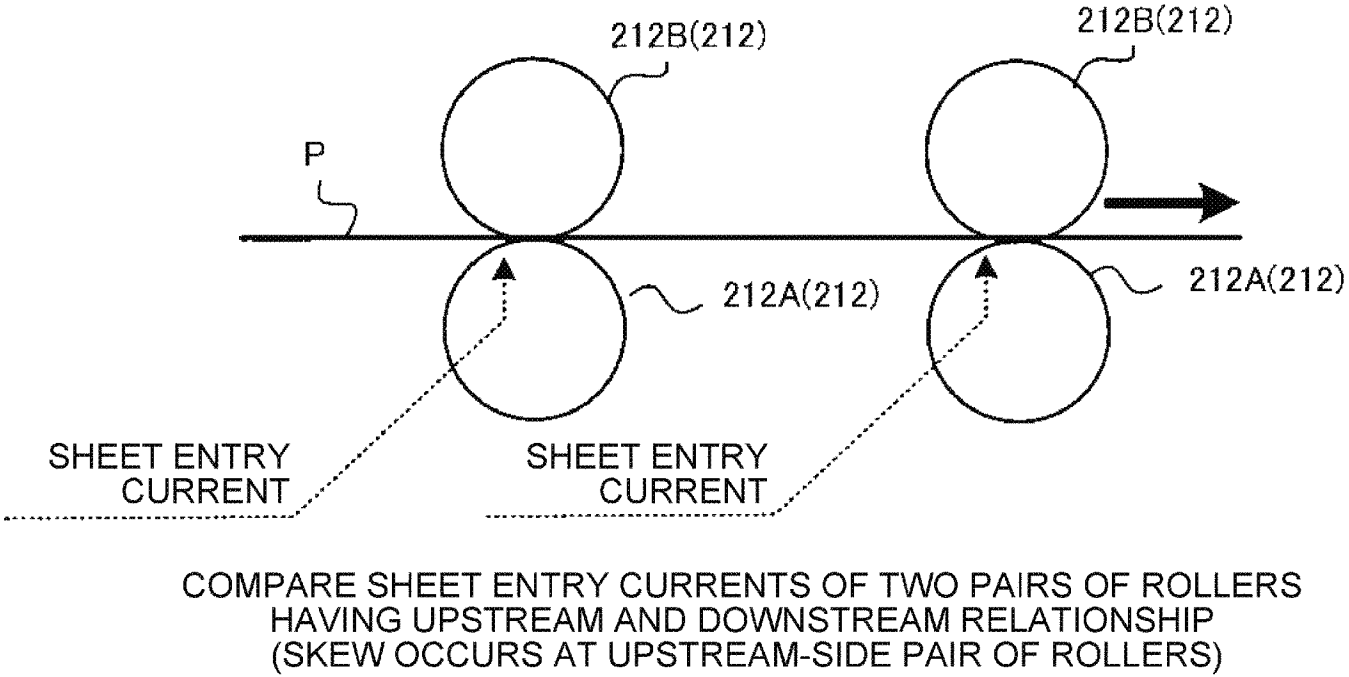

In the second modification, as illustrated in FIG. 10C, comparison is made between half-value widths obtained from waveforms of sheet entry currents of two pairs of rollers 212 having an upstream and downstream relationship. In this case, it is possible to determine whether a skew has occurred between the two selected pair of rollers 212.

As the two pairs of rollers 212, any rollers may be selected from the feed rollers 44A and 44B, the registration rollers 46A and 46B, the secondary transfer roller 38, the heating roller 30A, the pressure roller 30B, the sheet discharge rollers 58A and 58B, and the backup roller 36.

Example

Figure 11A:
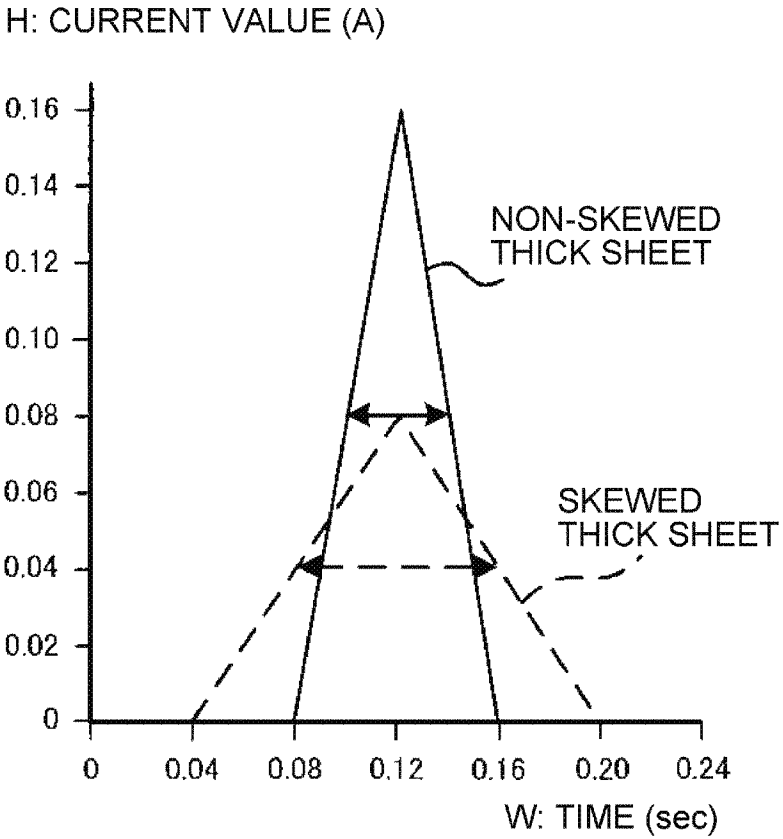
FIG. 11A is a motor driving current characteristic diagram on a skewed thick sheet and a non-skewed thick sheet according to examples of the first and second exemplary embodiments (including modifications)
Figure 11B:
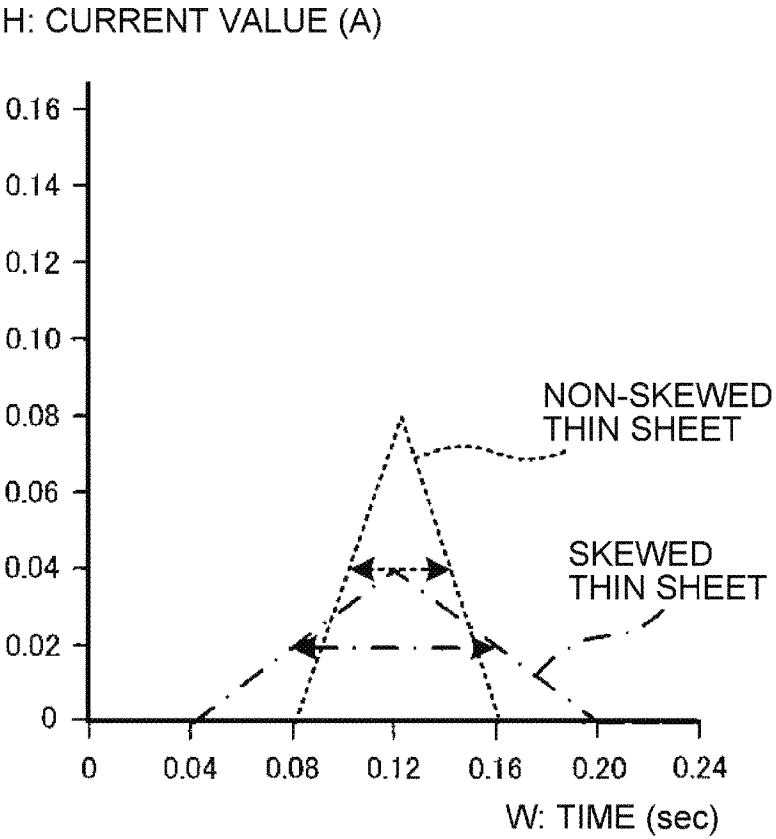
FIG. 11B is a motor driving current characteristic diagram on a skewed thin sheet and a non-skewed thin sheet according to the examples of the first and second exemplary embodiments (including modifications)

FIGS. 11A to 11C illustrate a discussion obtained from results of motor driving currents measured under respective situations such as a non-skewed thick sheet, a skewed thick sheet, a non-skewed thin sheet, and a skewed thin sheet when relatively thick and thin sheets are applied as recording sheets P, and the applied recording sheets P are transported.

In FIGS. 11A to 11C, two types of recording sheets P are applied in which the thickness ratio between a thick sheet to a thin sheet is 2:1.

FIG. 11A is a characteristic diagram illustrating a waveform of a sheet entry current extracted from a motor driving current when a thick sheet is applied as a recording sheet P.

In a case of a non-skewed thick sheet, the peak value is 0.16 A, and the half-value width is 0.04 (sec).

Meanwhile, in a case of a skewed thick sheet, the peak value is 0.08 A, and the half-value width is 0.08 (sec).

FIG. 11B is a characteristic diagram illustrating a waveform of a sheet entry current extracted from a motor driving current when a thin sheet is applied as a recording sheet P.

In a case of a non-skewed thin sheet, the peak value is 0.08 A, and the half-value width is 0.04 (sec).

Meanwhile, in a case of a skewed thin sheet, the peak value is 0.04 A, and the half-value width is 0.08 (sec).

When the results of FIGS. 11A and 11B are charted, as illustrated in FIG. 11C, it can be found that there are differences in respective monitoring elements (a peak current value (H), a feature amount (differential value) (H/W), and a half-value width (W)) between skew and no skew. That is, when a comparison to a preset threshold value is made, a threshold value may be set according to the type of paper (thickness of a recording sheet P).

Meanwhile, when the monitoring element is a half-value width (W), determination on skew or no skew may be made regardless of the thickness of a recording sheet P.

As illustrated in FIG. 10B, when a comparison is made between half-value widths at an entry side and a discharge side in a single pair of rollers 212, determination on skew or no skew may be made regardless of the thickness of a recording sheet P.

As illustrated in FIG. 10C, when a comparison is made between half-value widths of sheet entry currents of two pairs of rollers 212 having an upstream and downstream relationship, determination on skew or no skew may be made regardless of the thickness of a recording sheet P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport monitoring control device comprising:

a transport unit configured to transport a recording medium while nipping the recording medium;

a driving unit configured to drive the transport unit;

a detector configured to detect a waveform related to a load of the driving unit when the recording medium enters the transport unit or is discharged from the transport unit; and a determining unit configured to determine whether the recording medium is skewed with respect to the transport unit, based on a waveform width at a height obtained by multiplying a peak value of the waveform by a predetermined coefficient.

2. The transport monitoring control device according to claim 1, further comprising:

a notifying unit configured to notify of a result of determination made by the determining unit.

3. The transport monitoring control device according to claim 1, wherein the determining unit determines whether the recording medium is skewed, based on a comparison with a waveform width, which is stored in advance, when the recording medium is transported normally.

4. The transport monitoring control device according to claim 2, wherein the determining unit determines whether the recording medium is skewed, based on a comparison with a waveform width, which is stored in advance, when the recording medium is transported normally.

5. The transport monitoring control device according to claim 1, wherein the determining unit determines whether the recording medium is skewed, based on a comparison of waveform widths which are respectively detected at two different positions on a transport path.

6. The transport monitoring control device according to claim 2, wherein the determining unit determines whether the recording medium is skewed, based on a comparison of waveform widths which are respectively detected at two different positions on a transport path.

7. The transport monitoring control device according to claim 5, wherein the waveform widths detected at the two positions are (i) a waveform width which is detected when the recording medium enters a single transport unit and (ii) a waveform width which is detected when the recording medium is discharged.

8. The transport monitoring control device according to claim 6, wherein the waveform widths detected at the two positions are (i) a waveform width which is detected when the recording medium enters a single transport unit and (ii) a waveform width which is detected when the recording medium is discharged.

9. The transport monitoring control device according to claim 5, wherein the waveform widths detected at the two positions are waveform widths which are detected when the recording medium enters two or more transport units having a relative upstream-downstream relationship in a transport direction or when the recording medium is discharged from the two or more transport units.

10. The transport monitoring control device according to claim 6, wherein the waveform widths detected at the two positions are waveform widths which are detected when the recording medium enters two or more transport units having a relative upstream-downstream relationship in a transport direction or when the recording medium is discharged from the two or more transport units.

11. An image forming apparatus comprising:

a transport unit configured to transport a recording medium, which is taken out from an accommodating unit, along a preset transport path while the recording medium is nipped by a plurality of pairs of rollers each of which is driven by a driving force of a driving unit;

a transfer member serving as one of the plurality of pairs of rollers in the transport unit, wherein when facing the recording medium being transported, the transfer member transfers an image at a position where the transfer member faces the recording medium;

a detector configured to detect a waveform related to a load of the driving unit when the recording medium enters the pairs of rollers or is discharged from the pairs of rollers; and a determining unit configured to determine whether the recording medium is skewed with respect to the transport unit, based on a waveform width at a height obtained by multiplying a peak value of the waveform by a predetermined coefficient.

* * * * *